US005332704A

United States Patent [19]

Bartholic

[11] Patent Number: 5,332,704

[45] Date of Patent: Jul. 26, 1994

[54] FLUIDIZED PROCESS FOR IMPROVING THE QUALITY OF A PARTICULATE REGENERATED SOLID

[75] Inventor: David B. Bartholic, Watchung, N.J.

[73] Assignee: Bar-Co Processes Joint Venture, Houston, Tex.

[21] Appl. No.: 39,570

[22] Filed: Mar. 19, 1993

[51] Int. Cl.[5] ..... B01J 38/30; B01J 38/72; C10G 11/18; C10G 9/32

[52] U.S. Cl. ..... 502/41; 208/113; 208/150; 208/153; 208/161; 208/164; 422/144; 422/145; 502/21

[58] Field of Search ..... 502/21, 41, 42, 43; 208/113, 120, 150, 151, 153, 157, 161, 164, 176

[56] References Cited

U.S. PATENT DOCUMENTS

| | | | |
|---|---|---|---|
| 3,351,548 | 11/1967 | Payne et al. | 502/41 |
| 3,389,076 | 6/1968 | Oldweiler | 208/164 |
| 3,443,908 | 5/1969 | Chaney et al. | 208/164 |
| 3,893,812 | 7/1975 | Conner et al. | 208/164 |
| 3,926,778 | 12/1975 | Owen et al. | 208/74 |
| 4,263,128 | 4/1981 | Bartholic | 208/91 |
| 4,693,809 | 9/1987 | Bartholic et al. | 208/164 |
| 4,851,108 | 7/1989 | Bartholic et al. | 502/41 |
| 4,859,315 | 8/1989 | Bartholic | 208/153 |
| 4,985,136 | 1/1991 | Bartholic | 208/153 |
| 5,132,480 | 7/1992 | Tsutsui et al. | 502/41 |

*Primary Examiner*—Paul E. Konopka
*Attorney, Agent, or Firm*—Finnegan, Henderson, Farabow, Garrett & Dunner

[57] ABSTRACT

A fluidized solid process for upgrading or converting a hydrocarbon feedstock wherein carbonaceous deposits accumulate on a particulate fluidized solid and are burned in a regenerator to regenerate the solid, the regenerated solid and entrained combustion products are introduced into a vertical lift pipe, a fluid lift medium is introduced into the lift pipe and the regenerated solid is separated from the lift medium and combustion products to improve the quality of the regenerated solid contacted with the hydrocarbon feedstock.

23 Claims, 1 Drawing Sheet

FLUIDIZED PROCESS FOR IMPROVING THE QUALITY OF A PARTICULATE REGENERATED SOLID

FIELD OF THE INVENTION

This invention relates to the processing of hydrocarbon feedstocks wherein the hydrocarbon feedstock is contacted with a fluidized particulate solid which accumulates carbonaceous deposits thereon, is regenerated by burning the deposits and the regenerated solid is returned to a contacting zone. More particularly, this invention relates to a method for improving the quality of such regenerated solid returned to the contacting zone.

BACKGROUND OF THE INVENTION

Since the fluidized catalytic cracking (FCC) process was first introduced in the 1940s, the FCC process hydrocarbon feed has been used as the fluidizing media in the reactor and also to convey the regenerated catalyst from the bottom of the reactor riser up to the reactor cyclone or disengaging vessel. In the typical riser cracking FCC system that is used worldwide today, the hot regenerated catalyst is mixed at or near the base of the reactor riser with feed. The hot regenerated catalyst acts as the heat source for vaporizing the feed and also acts as a catalyst to convert the feed to lower molecular weight product. This vaporization and conversion of the feed results in vapors which are used to convey the catalyst up the riser to the spent catalyst-reactor vapor disengaging vessel where the reactor vapors and spent catalyst are separated from each other. After separation, the spent catalyst flows downwardly into a catalyst stripper, then into the regenerator where it is regenerated and then back to the base of the riser to complete the circuit. The reactor vapors, after separation from the majority of the spent catalyst, are fractionated into the desired products.

The hydraulics of the typical FCC process are very well known and are based upon the fact that a dense bed of fluidized catalyst will develop a higher pressure differential than a dilute phase of fluidized catalyst. As an example, the normal fluidized dense bed, as employed in regenerators, reactor beds or strippers that have upward velocities of between 0.5 and 3.5 feet per second (fps) superficial velocity will have densities of between 15 and 40 pounds per cubic foot (#/ft$^3$) which equates to 0.10 to 0.28 pounds per square inch (psi) per foot of dense bed height. The catalyst circulating lines, such as regenerated catalyst and spent catalyst standpipes, which normally have little or no added fluidizing media or no significant upward gas superficial velocity will have densities between 25 and 50 # ft$^3$ which equates to 0.17 to 0.35 psi per foot of height. The reactor riser with an average velocity of 50 fps and catalyst to oil ratios of around 7 pounds of catalyst per pound of oil will have a density of 3.2 #/ft$^3$ with a 2/1 slip factor. This 3.2 #/ft$^3$ density will result in a pressure drop across the typical 120 foot long riser of about 2.7 psi or 0.022 psi per foot. Note that the typical riser pressure drop per foot is about 13 to 6% of the pressure drop in the spent and regenerated catalyst standpipes. This hydraulic difference allows the catalyst in the fluid catalytic cracking unit to circulate.

There are many configurations for the FCC process. Some have the reactor higher than the regenerator or vice versa. Some have the reactor and regenerator at the same elevation. Usually, if the reactor and regenerator are at the same elevation, the design operating pressures of both vessels are the same. For those units where the reactor and regenerator are at different elevations, the higher vessel operates at a lower pressure than the lower vessel. Usually this difference in pressure is no more than 5–10 psi. As is readily apparent in the design of an FCC unit (FCCU), as in any other unit, once the unit is built there are definite limits as to what can and cannot be done in the existing equipment.

As is apparent from the age of many of the FCC units still in operation, the refining industry has been very creative in increasing the capacity of existing systems and utilizing new catalyst and process technology with minimum changes to the existing reactor and regenerator vessels.

My U.S. Pat. No. 4,985,136, issued Jan. 15, 1991, and entitled "ULTRA-SHORT CONTACT TIME FLUIDIZED CATALYTIC CRACKING PROCESS" describes an FCC system that differs markedly from the typical riser cracking FCC process employed in the worldwide refining industry. U.S. Pat. No. 4,985,136 is incorporated herein by reference in its entirety. This ultra-short contact time fluidized catalytic cracking system is known in the industry as the "Milli-Second Catalytic Cracking" or "MSCC" process. The MSCC process described in my patent does not have a riser reactor and does not rely on feed vaporization and conversion to circulate the catalyst. Instead, the MSCC system employs a dispersion medium, or media, to disperse the regenerated catalyst downwardly into the feed, which is injected essentially horizontally into the MSCC contactor, or reactor. This dispersed downward flow of regenerated catalyst and dispersion media is critical to the proper hydraulic operation of the MSCC system. Locating the regenerator above the MSCC contactor requires that the regenerator vessel be located at over 100 feet above grade. This is not always acceptable for large capacity units which require large vessels, or in areas of high wind loadings or earthquake zones.

In addition to the mechanical considerations of MSCC technology, ultra-short contact time FCC process conditions differ markedly from those in the conventional FCC process. The heat balance is one area of considerable difference. Because of the short contact time reaction system employed, the catalyst to oil ratio can be 25:1 or greater. This compares to conventional FCC processes, where catalyst to oil ratios of 4:1 to 10:1 are common. This higher than normal catalyst to oil ratio results in approximately a threefold increase in the amount of combustion products resulting from the burning of the carbonaceous deposits on the catalyst, or "inerts," entrained into the reaction section. Such inerts may include CO, $CO_2$, $H_2S$, $SO_x$ (sulfur oxides), $H_2O$, $N_2$ and the like which are not desired in a fuel gas. This increases the loadings in the downstream fractionation system and gas concentration unit and lowers the quality of the fuel gas produced while increasing the amount of fuel gas. Also, the higher circulation rates required in ultra-short contact time FCC results in increase pressure drop across the reactor riser which will limit the catalyst circulation capabilities of existing equipment or require more lift media to reduce the reactor riser density. This increase in lift media will increase the loadings on the whole reactor system and downstream fractionation, which may result in reducing the throughput of existing systems or drastically increase the cost of new systems.

Therefore, a principal object of the present invention is to remove the regenerated catalyst from the normal FCC circulation route so that it can be treated to improve its quality and to give an independent control of pressure balance to allow for higher catalyst to oil ratios without overloading the downstream equipment with lift media.

Another object of the invention is to greatly reduce, by dilute phase stripping with the lift vapor, the amount of inerts entrained with the regenerated catalyst into the reaction system. This will reduce the quantity of fuel gas produced in the MSCC process by 40 to 150%. Since the catalyst to oil ratio in the MSCC process is about three times that of a conventional FCC, the amount of inerts in the fuel gas product typically will be increased by about three times. If the inerts are not removed in accordance with the present invention, the inert content of the fuel gas produced by the MSCC process may be as high as 70%, so that the quality of the fuel gas product is greatly reduced.

Still another object of the present invention is to reduce the catalyst carryover from the FCC reactor into the main fractionator by employing a cyclonic separation of the circulating catalyst to eliminate a majority of the catalyst fines (undesirably small catalyst particles) from the reaction zone.

Yet another object of the present invention is to condition the catalyst to obtain yield and product benefits in the practice of an FCC process. There has long been a desire on the part of refiners to have the ability to maximize gasoline or distillate, as desired. Up to now, this ability has not realized as it normally required a change in catalyst activity to accomplish this yield shift. Now in accordance with the present invention, by selecting the proper media mixture one can change the catalyst activity at will by laying down greater or lesser amounts of coke on the circulating regenerated catalyst in a lift pipe as hereinafter described. Thus, one can obtain almost instant catalyst activity control in the operation of an FCC process and easily switch from maximum gasoline to maximum distillate.

A further object of the present invention is to enable the production of olefins and petrochemical feedstocks from a second hydrocarbon feedstock used as the lift media or as a portion of the lift media.

Another object of the present invention is to reduce the increase in coke yield associated with using a lift media other than hydrocarbon feed to circulate the catalyst into the reactor system of an FCCU.

In one embodiment the need for regenerator catalyst coolers can be obviated by use of the process of the present invention.

Yet another object of the present invention is to hydrate the regenerated catalyst so as to increase the circulating catalyst activity.

Another object of the present invention is to separate the reactor regenerator hydraulics so that the regenerator does not have to be located above the reactor.

SUMMARY OF THE INVENTION

To achieve the objects and in accordance with the purposes of the present invention, there is provided an improvement in a fluidized solid process wherein a fluidized particulate solid is contacted in a contacting zone with a hydrocarbon feedstock and becomes spent as a result of accumulating carbonaceous deposits thereon, fluidized spent solid is circulated to a regenerator in which the carbonaceous deposits are burned so as to regenerate the solid and regenerated solid is circulated to the contacting zone, the improvement comprising:

(a) withdrawing hot fluidized regenerated solid and entrained combustion products from the regenerator;

(b) introducing the withdrawn regenerated solid and entrained combustion products into a lower portion of an elongated vertical lift pipe;

(c) introducing a fluid lift medium into a lower portion of the lift pipe to intimately contact the regenerated solid therein;

(d) passing a stream of the fluidized regenerated solid, entrained combustion products and lift medium upwardly in the lift pipe to an upper portion thereof;

(e) passing the stream to a separation zone and separating therein regenerated solid from the lift medium and combustion products;

(f) passing the separated regenerated solid having a reduced amount of entrained combustion products to the contacting zone for contact therein with the hydrocarbon feedstock; and (g) processing the separated lift medium and combustion products for further use or disposal.

In one embodiment of the present invention, the process is an FCC process and the particulate solid is a finely divided cracking catalyst. Preferably, the contacting zone is a riser reactor wherein the separated regenerated catalyst and hydrocarbon feedstock are passed upwardly in an elongated reactor, or the separated regenerated catalyst is dispersed downwardly into a substantially horizontal stream of atomized hydrocarbon feedstock.

In another embodiment of the present invention, the process is a liquids-solids separation process or hydrocarbon upgrading process, wherein the particulate solid is substantially inert and has substantially no activity for the conversion of hydrocarbons under the conditions of said process occurs in said reactor.

In accordance with the present invention, the lift media is preferably steam, water, hydrocarbon gases, hydrocarbon liquids or mixtures thereof.

BRIEF DESCRIPTION OF THE DRAWING

The present invention will be described with reference to the accompanying drawing, wherein.

DESCRIPTION OF THE PREFERRED EMBODIMENTS

Figure 1:
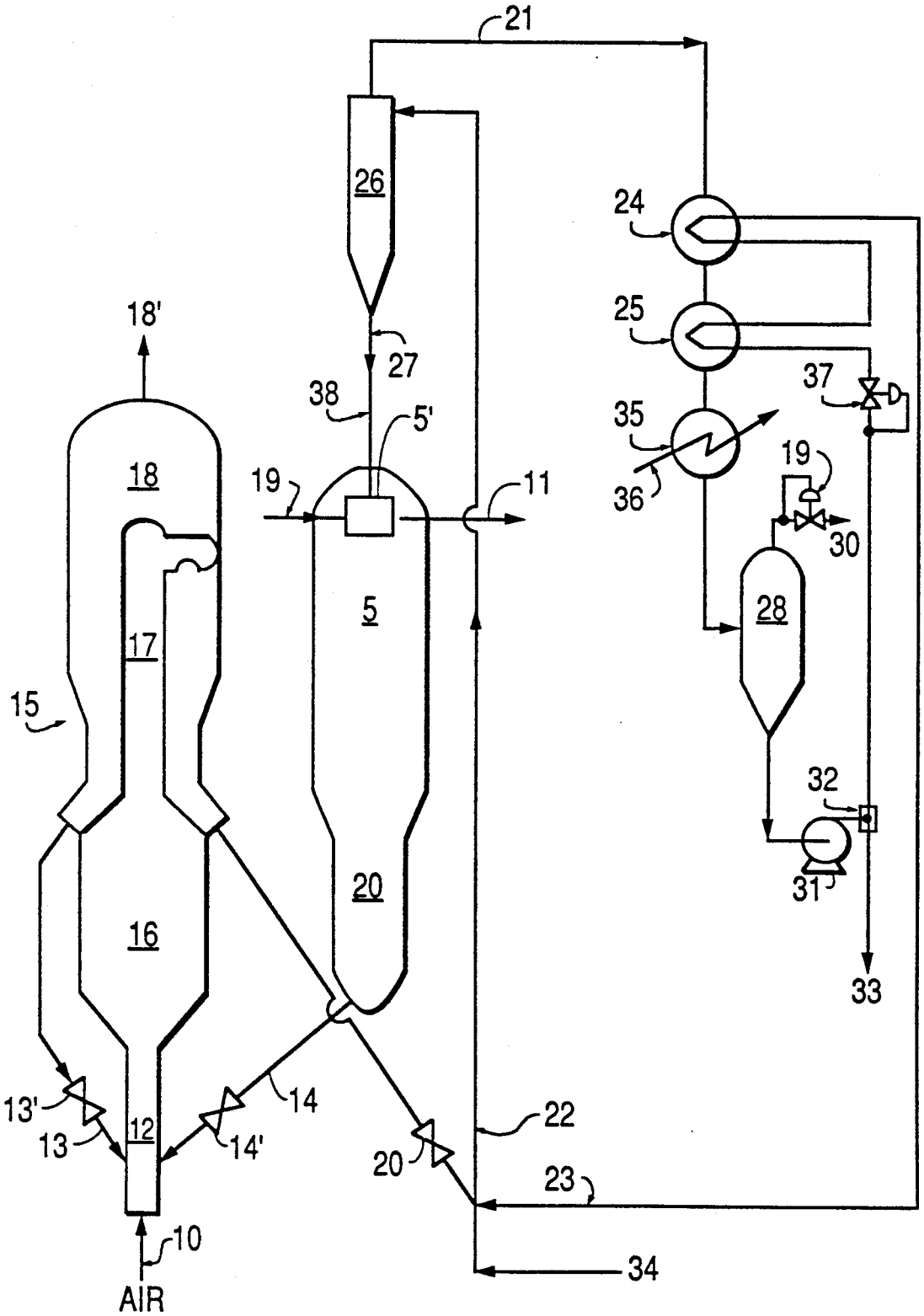
FIG. 1 is a schematic diagram illustrating a preferred system for practice of the present process of the invention.

The reactor and regenerator structure depicted in FIG. 1 is commonly referred to as the "UOP high efficiency" design and is described in U.S. Pat. Nos. 3,893,812 and 3,926,778, both of which are incorporated by reference herein in their entireties. However, other types of reactor and regenerator structures may also be used with the present invention. While the present invention will be described with reference to the FCC process, it can also be used in various other fluidized solids circulating systems, including those described in my U.S. Pat. No. 4,859,315, issued Aug. 22, 1989, and entitled "LIQUID-SOLID SEPARATION PROCESS AND APPARATUS" and U.S. Pat. No. 4,263,128, issued Apr. 21, 1981, and entitled "UPGRADING PETROLEUM AND RESIDUAL FRACTIONS THEREOF," both of which are incorporated herein by reference in their entireties.

As shown in FIG. 1, combustion air is introduced into regenerator 15 through line 10 into the bottom portion of regenerator mix chamber 12 where it is mixed with spent catalyst introduced through line 14, and regenerated catalyst introduced through line 13. The flow of spent catalyst is regulated by spent catalyst slide valve 14' on reactor 5 level control and the flow of regenerated catalyst is regulated on flow control to maintain the desired temperature in lower combustor 16 by slide valve 13'. The resulting mixture is fluidized upwardly with the combustion air through the lower combustor 16, combustor riser 17, and into the upper combustion chamber 18. In regenerator 15 carbonaceous deposits are burned from the spent catalyst to form regenerated catalyst and flue gas. The upper combustor normally contains two stage cyclones to separate the regenerated catalyst from the flue gas exiting the upper combustor 18 through line 18'. The regenerated catalyst settles into the bottom of the upper combustor 18 where it can flow downwardly through slide valve 13' as discussed above or through regenerated catalyst slide valve 20 on reactor outlet vapor 11 temperature control into the bottom portion of lift pipe 22.

In the bottom portion of lift pipe 22, the regenerated catalyst and entrained inerts are mixed with a well dispersed lift media, which is introduced through line 23 to achieve intimate contact. Preferably, the lift media is steam, which is generated and superheated in exchangers 24 and 25. The resulting mixture of regenerated catalyst, entrained inerts and lift media flow upwardly through lift pipe 22 into the first stage of cyclone separators 26. Only one cyclone separator is shown but in the preferred embodiment there would be two stages of cyclone separation.

The regenerated catalyst essentially free of inerts is separated in cyclone 26 and flows downwardly through dipleg 27 where it is accelerated downwardly with a dispersion media introduced through line 38 into the MSCC contactor 5' located in the top of reactor 5 wherein the downwardly flowing dispersed regenerated catalyst and hydrocarbon feed introduced horizontally through line 19 are mixed together as described in my U.S. Pat. No. 4,985,136. The catalyst to oil weight ratio in the MSCC reactor 5' preferably is greater than 10 to 1, and may be up to 25 to 1 or greater. The reactor vapors exit the reactor through line 11 after separation from the spent catalyst. The spent catalyst flows downwardly through stripper 20 and through spent catalyst slide valve 14' to complete the circuit.

The vapors and a majority of the catalyst fines and entrained inerts that otherwise, in a "conventional" FCC process design, would have exited the reactor cyclones in the reactor vapors now exit cyclones 26 via line 21 and flow into exchanger 24 which acts to desuperheat the vapors from cyclones 26 and superheat the lift media flowing in line 23. The desuperheated vapors from exchanger 24 enter exchanger 25 where the vapors are condensed into water. The water from exchanger 25 enters exchanger 35 where the water is cooled to about 100° F. with cooling water supplied via line 36. The resultant cooled water together with catalyst fines and inerts enters receiver 28 where the catalyst fines and water are separated from the inerts. The inerts exit the top of receiver 28 on differential pressure control between the reactor 5 and receiver 28 through line 30 to disposal. The water and catalyst fines exit the bottom of receiver 28 through pump 31 which adds additional head to the water so that it can flow first through a catalyst/water separating device 32, such as hydroclones, and then through flow control 37 and exchanger 25 to become steam and exchanger 24 to be superheated before entering lift pipe 22 through line 23. The separated catalyst fines are sent to disposal or back to the reactor or regenerator vessels through line 33. Make-up lift media can be added through line 34.

By using steam as the lift media and installing this process to recover the heat in the vapors by superheating the steam to within 50° to 100° F. of the regenerator catalyst temperature, the coke yield increase required to heat this media to operating conditions will be greatly reduced compared to utilizing a saturated steam as lift media.

If it is desired to use water as the lift media instead of steam so that one can eliminate or reduce the need for regenerated catalyst coolers, the only required changes in the above design are to bypass exchangers 25 and 24 with the condensed water from receiver 28 and pump 31 and go on flow control 37 directly to the lift pipe 22 through line 23 after the water-catalyst separator 32. The cooling media used in exchanger 25 can then be boiler feed water which will produce steam in exchanger 25 and be superheated in exchanger 24 before it is added to the refinery steam system. Other cooling medias could be used in exchangers 24 and 25, but boiler feed water and steam are the preferred media.

The use of hydrocarbon lift media will normally require a once through system wherein the lift media is added through line 34, and line 23 is eliminated. Exchangers 24 and 25 may be converted to serve for steam generation as discussed above and pump 31 may or may not be necessary.

In accordance with one embodiment of the present invention regenerated catalyst flow control valve 20 is used to regulate the flow of regenerated catalyst into lift pipe 22 using a lift media, such as steam, water, sour water from the downstream fractionation system, fuel gas, whose primary composition is ethane and lighter, propane, butane, or other hydrocarbon liquids or gases. In order to minimize the pressure drop across the lift pipe, the lift pipe should be vertical. The quantity of lift media used should be that needed to control the density in the lift pipe at less than 15, preferably between 2.0 and 15, $\#/ft^3$ at a velocity of less than 120, preferably between 12 and 120, feet per second (fps). The catalyst residence time in the lift pipe should be as short as possible, preferably less than 10 seconds, and with less than 4 seconds most preferred. At the top of the lift pipe 22 the catalyst and vapors enter one or two stages of cyclone separators 26 to separate at substantially all, e.g., at least 99%, of the circulating catalyst from the lift media vapors. The separated hot regenerated catalyst, which is free of most of the catalyst fines, flows down the cyclone dipleg 27 where the catalyst can either be collected into a regenerated catalyst surge vessel (not shown) or flow directly down into the MSCC contactor 5' after having been dispersed and accelerated with dispersion media as discussed in U.S. Pat. No. 4,985,136.

The type of lift media employed in the lift riser will be determined by the objective to be accomplished.

Steam may be used to reduce the quantity of inerts entrained with the regenerated catalyst into the MSCC reaction zone. The inerts may be replaced by steam vapors so that the amount of gas entering the reaction system and downstream gas compressor will be reduced and the quality of the fuel gas will be improved by having less inerts and more BTU value.

In cases where the feed to the MSCC unit is residual oil of greater than 2.0 w% Conradson Carbon, water or sour water from the main column overhead receiver may be used to cool the regenerated catalyst and reduce or eliminate the amount of catalyst cooling required in the regenerator. The hot regenerated catalyst may be cooled by vaporizing the water at the base of the lift line. The resulting vapor can act as the lift media. Using water as the lift media will also reduce the quantity of inerts entrained with the regenerated catalyst into the reaction section. Use of water and steam will also hydrate the catalyst and improve the circulating activity.

Fuel gas of low molecular weight, mainly $C_2$ minus, can be used as a lift media to reduce the inerts entrained into the reaction section with the regenerated catalyst. This type of fuel gas would have little or no conversion, so it would not lay down coke on the regenerated catalyst and thereby reduce the circulating catalyst activity.

The use of propane, butanes, and other such light hydrocarbon liquids and gases as lift media to produce olefins and petrochemical feedstocks will also reduce the inert carryover into the reaction system. This type of operation will lay down coke on the catalyst in the lift line and therefore reduce the circulating catalyst activity. Therefore in most cases, this type of lift media would be used along with steam or water to control the amount of coke deposition or loss in effective circulating catalyst activity. The use of water, since it acts to cool the regenerated catalyst, will increase the catalyst circulation rate and therefore can be used to maintain the effective catalyst activity at the point of feed and catalyst contact.

The use of $H_2S$ or gases containing $H_2S$ as the lift media can be used to sulfide the metals, such as nickel, vanadium, iron, and sodium, on the circulating catalyst to reduce their activity.

On regenerated catalyst with less than 0.1 wt % carbon on catalyst, hydrocarbons heavier than ethylene can be used as the lift media to take the edge off the catalyst activity by depositing carbon on the circulating catalyst.

The separated hot regenerated catalyst exiting the bottom of the cyclone separator 26 is now of improved quality. It is essentially free of catalyst fines, inerts, and lift media and has been improved by proper selection of the lift media. The vapors and small amount of catalyst fines separated from the regenerated catalyst in the cyclone separator(s) exit the cyclone and can be vented off to proper disposal or either compressed and sent back around to the bottom of the lift line to contact new regenerated catalyst or, in the preferred mode, condensed in a series of exchangers to produce a liquid and gas product. In the latter case, the liquid product can be recycled back to the bottom of the lift line as lift media or vaporized by exchange with the cyclone vapors and used as a vapor lift media. The gas product can be vented off on pressure control to recovery.

If desired, it is possible to recycle the cyclone vapors by compressing the vapors (i.e., boosting the pressure) and recycling them back to the bottom of the lift line. In this case there would be no increase in the coke yield, and one could use only inerts that are entrained from the regenerator to the bottom of the lift line with the regenerated catalyst as the lift media.

In the majority of operations, the selection of the lift media will be between steam/water or low molecular weight fuel gas. For operations where the regenerated catalyst is above 1350° F., a low molecular weight fuel gas is preferred unless one wishes to produce petrochemical feedstocks and olefins. For regenerated catalyst temperatures below 1350° F., steam or water is the preferred lift media, with water preferred down to about 1230° F. and steam below 1230° F.

EXAMPLE

As an example, in a 25,280 BPD MSCC unit operating at 35 psi in both the reactor 5 and regenerator 18, circulating 70.9 tons per minute (T/M) of regenerated catalyst, the lift riser would be about 4 feet in diameter and require about 160,000 pounds per hour of lift steam. This lift steam rate is about 50 w% of the feed rate or about 250 mole % of the reactor vapor.

The maximum amount of inerts entrained with the regenerated catalyst into the lift riser is estimated to be about 13,000 pounds per hour, or about 4 w% on feed and about 12 mole % on reactor vapors. The stripping of these inerts from the reactor vapors reduces the gas compressor and gas concentration loadings and increases the value of the fuel gas produced.

The 70.9 T/M of 1250° F. regenerated catalyst and 13,000 #/hr of entrained inerts flows through slide valve 20 into lift pipe 22 where it is contacted with 160,000 #/hr of superheated lift steam from line 23 and line 34. The resultant mixture at about 1240° F. and 70 fps is transported up the lift line 22 to cyclone 26 where a catalyst stream comprising 99%+ of the regenerated catalyst with entrained steam plus a minor portion, e.g., plus less than 10%, of the original entrained inerts is separated from a vapor stream which consists of the lift vapors and remaining inerts and catalyst fines. The separated catalyst stream flows downwardly through dipleg 27 where it is dispersed with dispersion media from line 38. The dispersed catalyst is mixed with hydrocarbon feed from line 19 in MSCC contactor 5' in reactor 5 to produce reactor vapors and spent catalyst stream. After separation, the reactor vapors exit through line 11 and separated spent catalyst flows downwardly into the stripper 20, spent catalyst slide valve 14' and into the regenerator mix chamber 12 to be regenerated and returned to the base of the lift riser 22 to complete the circuit. The reactor vapors exiting through line 11 contain less catalyst fines because of the pre-separation in cyclone 26, and with only a small percentage of the original inerts entrained with the regenerated catalyst the vapors exit reactor 5 to be fractionated into the desired products in the main fractionator and gas concentration unit (not shown).

Cyclone 26 vapors at about 1240° F. enter exchanger 24 to be desuperheated by heat exchange with steam. The desuperheated vapors enter exchanger 25 to be condensed by heat exchange with water to produce steam. The condensed water from exchanger 24 enters exchanger 35 to be cooled by cooling water from line 36 to about 100° F. The cooled condensate with the catalyst fines and inerts flows into receiver 28 where the water and catalyst are separated from the inerts. The inerts with some water vapor exit receiver 28 on differential pressure control between the reactor 5 and receiver 28. The condensed water (condensate) plus catalyst fines and some inerts that are in solution are pumped by pump 31 into hydroclones 32 to separate the water and 99%+ of the catalyst fines. The catalyst fines plus entrained water from hydroclones 32 are sent to disposal. The condensate, essentially free of catalyst fines, flows to exchanger 25 through flow control 37 where it is vaporized to steam. The steam flows to exchanger 24 where it is superheated before it is injected into the bottom of lift line 22 through line 23 to complete the circuit.

Additional lift media can be added through line 34 to make up for the lift media entrained with the catalyst from cyclone 26, lost with the inerts from receiver 28 and lost with the catalyst fines from hydroclones 32. Line 34 is shown as one line, but it may be as many lines as desired for different lift media as discussed above, so that more than one lift media could be used at a time. If desired, line 34 may enter at any point after the cyclone vapors exit the cyclone 26 and the base of the lift line 22 as indicated in FIG. 1.

Having described preferred embodiments of the present invention, it should be understood that modifications and variations thereof falling within the spirit and scope of the invention may become apparent to those skilled in the art, and the scope of the present invention is to be determined by the appended claims and their equivalents.

What is claimed is:

1. In a fluidized solid process wherein a fluidized particulate solid is contacted in a contacting zone with a hydrocarbon feedstock and becomes spent as a result of accumulating carbonaceous deposits thereon, fluidized spent solid is circulated to a regenerator in which the carbonaceous deposits are burned so as to regenerate the solid and regenerated solid is circulated to the contacting zone, the improvement comprising:

(a) withdrawing hot fluidized regenerated solid and entrained combustion products from the regenerator;

(b) introducing the withdrawn regenerated solid and entrained combustion products into a lower portion of an elongated vertical lift pipe;

(c) introducing a fluid lift medium into a lower portion of said lift pipe to intimately contact the regenerated solid therein;

(d) passing a stream of the fluidized regenerated solid, entrained combustion products and lift medium upwardly in said lift pipe to an upper portion thereof;

(e) passing said stream to a separation zone and separating therein regenerated solid from said lift medium and combustion products;

(f) passing the separated regenerated solid having a reduced amount of entrained combustion products to said contacting zone for contact therein with said hydrocarbon feedstock; and (g) recycling separated lift medium to said lift pipe to intimately contact the regenerated solid therein.

2. The process of claim 1, wherein said contacting zone is a fluidized catalytic cracking reactor and the particulate solid is a finely divided cracking catalyst.

3. The process of claim 2, wherein said reactor is a riser reactor wherein the separated regenerated catalyst and hydrocarbon feedstock are passed upwardly in an elongated reactor or the separated regenerated catalyst is dispersed downwardly into a substantially horizontal stream of atomized hydrocarbon feedstock.

4. The process of claim 1, wherein the particulate solid is substantially inert and substantially no activity for the conversion of hydrocarbons under the conditions of said process occurs in said reactor.

5. The process of claim 1, wherein said lift medium is a fluid selected from the group consisting of steam, water, and mixtures of steam or water with hydrocarbon gases or hydrocarbon liquids.

6. The process of claim 1, wherein said process conducted in an existing fluidized solid process system which has been modified to permit the practice of said process therein.

7. The process of claim 1, wherein said separated regenerated solid passed to said contacting zone is substantially free of said combustion products.

8. The process of claim 1, wherein said separated regenerated solid passed to said contacting zone is substantially free of fines.

9. The process of claim 2, wherein said separated regenerated solid passed to said contacting zone has been modified in activity.

10. The process of claim 1, wherein said separated regenerated solid passed to said contacting zone is substantially free of lift medium.

11. The process of claim 1, wherein said separation zone comprises one or more cyclone separators.

12. The process of claim 1, wherein said separated lift medium is heat exchanged with boiler feed water to produce steam.

13. The process of claim 1, wherein said separated lift medium is heat exchanged with condensed separated lift medium to produce superheated lift medium for recycle back to the bottom of the lift pipe.

14. The process of claim 2, wherein said lift medium comprises steam or water, the separated lift medium is condensed, the resulting condensate is treated to remove catalyst fines, and the resulting treated condensate is vaporized and injected into said lift pipe.

15. The process of claim 1, wherein said lift medium is water and is employed to cool said separated regenerated solid and to increase the solid to oil ratio in said contacting zone.

16. The process of claim 1, wherein said separated lift medium is comprised of hydrocarbon gas.

17. The process of claim 1, wherein the residence time of said solid in the lift pipe is less than 10 seconds.

18. The process of claim 1, wherein the residence time of said solid in said lift pipe is less than 4 seconds.

19. The process of claim 1, wherein the superficial velocity of said stream in said lift pipe is less than 120 fps.

20. The process of claim 1, wherein the density of said stream in said lift pipe is less than 15 pounds per cubic foot.

21. The process of claim 1, wherein the weight ratio of said regenerated solid to said hydrocarbon feedstock in said contacting zone is greater than 10 to 1.

22. The process of claim 1, wherein the temperature of said regenerated solid withdrawn from said regenerator is not greater than about 1350° F.

23. The process of claim 22, wherein said regenerated solids temperature is not greater than about 1250° F.

* * * * *